US008718152B2

(12) United States Patent
Iwano et al.

(10) Patent No.: US 8,718,152 B2
(45) Date of Patent: May 6, 2014

(54) TWO-WIRE TRANSMITTER

(75) Inventors: Youichi Iwano, Tokyo (JP); Ikuhiko Ishikawa, Tokyo (JP); Ryou Hagiwara, Tokyo (JP); Kazuyuki Endo, Tokyo (JP)

(73) Assignee: Yokogawa Electric Corporation, Tokyo (JP)

( * ) Notice: Subject to any disclaimer, the term of this patent is extended or adjusted under 35 U.S.C. 154(b) by 128 days.

(21) Appl. No.: 13/252,534

(22) Filed: Oct. 4, 2011

(65) Prior Publication Data

US 2012/0082204 A1 Apr. 5, 2012

(30) Foreign Application Priority Data

Oct. 5, 2010 (JP) ..... 2010-225577
May 26, 2011 (JP) ..... 2011-118027

(51) Int. Cl.
*H04L 25/00* (2006.01)

(52) U.S. Cl.
USPC ..... 375/259; 327/31; 327/1; 375/238

(58) Field of Classification Search
USPC ..... 375/238
See application file for complete search history.

(56) References Cited

U.S. PATENT DOCUMENTS 5,780,715 A * 7/1998 Imblum ..... 73/23.21
6,140,940 A * 10/2000 Klofer et al. ..... 340/870.39
6,560,279 B1 * 5/2003 Renz ..... 375/237
7,970,063 B2 * 6/2011 Schulte ..... 375/259
2007/0036212 A1 * 2/2007 Leung et al. ..... 375/238
2008/0075177 A1 * 3/2008 Noh ..... 375/258
2009/0028235 A1 * 1/2009 Park et al. ..... 375/238
2009/0231886 A1 * 9/2009 Xia et al. ..... 363/20
2012/0033747 A1 * 2/2012 Chi et al. ..... 375/257

FOREIGN PATENT DOCUMENTS

EP 0883097 A2 12/1998
JP 2007-066035 A 3/2007
WO WO 2005017851 A1 2/2005
WO WO 2010014102 A1 2/2010

OTHER PUBLICATIONS

European Search Report dated Jan. 19, 2012 issued by the European Patent Office in counterpart European Patent Application No. 11183888.4.

* cited by examiner

*Primary Examiner* — Chieh M Fan
*Assistant Examiner* — Santiago Garcia
(74) *Attorney, Agent, or Firm* — Sughrue Mion, PLLC

(57) ABSTRACT

There is provided a two-wire transmitter which is connected to an external circuit by two transmission lines and which outputs a certain current signal to the external circuit using the external circuit as a power source. The two-wire transmitter includes: a sensor configured to convert a physical quantity into a first electrical signal and output the first electrical signal; a signal processing circuit configured to perform certain processing on the first electrical signal and output a second electrical signal; a constant current circuit configured to determine the certain current signal to be output to the external circuit, based on the second electrical signal; a reference voltage output unit configured to output a reference voltage based on the second electrical signal; and a shunt regulator circuit configured to determine a circuit voltage of the two-wire transmitter based on the reference voltage.

14 Claims, 5 Drawing Sheets

CHARACTERISTIC OF P-CHANNEL MOSFET

FIG. 5

| SIGNAL | V3 | iV3 | SIGNAL PROCESSING CIRCUIT 104 | ERR | MOVABLE CONTACT OF SW4 | MOVABLE CONTACT OF SW2 |
|---|---|---|---|---|---|---|
| BEFORE ACTIVATION | L | H | — | — | $V_{R3}$ | — |
| AFTER ACTIVATION | H | L | NORMAL | L | $V_{R1}$ / $V_{R2}$ | PWM |
| | H | L | ABNORMAL | H | $V_{R1}$ | DIR=V2 |
| | | | | | $V_{R2}$ | DIR=GND |

TWO-WIRE TRANSMITTER

This application claims priority from Japanese Patent Applications No. 2010-225577, filed on Oct. 5, 2010, and No. 2011-118027, filed on May 26, 2011, the entire contents of which are herein incorporated by reference.

BACKGROUND

1. Technical Field

The present invention relates to a two-wire transmitter which is connected to an external circuit by two transmission lines and which outputs a prescribed current signal to the external circuit while using the external circuit as a power source.

2. Related Art

A two-wire transmitter is a device which is connected to an external circuit by two transmission lines and which converts prescribed information (a physical quantity) acquired from a sensor or the like into a current signal and outputs the current signal to the external circuit while using the external circuit as a power source. Two-wire transmitters are used widely as field devices such as a differential pressure/pressure transmitter and a temperature transmitter in individual plants because they do not require a dedicated power wiring and can be installed at a low cost. When used as a field device, a two-wire transmitter converts a physical quantity into a DC current signal of 4 to 20 mA (world standard of a field device signal) and sends it to an external circuit.

Japanese Patent Document JP-A-2007-66035 describes a current monitoring device which is a field device and employs a two-wire transmission scheme that does not require a power wiring as in two-wire transmitters. The current monitoring device described in JP-A-2007-66035 is equipped with a power voltage generator (shunt regulator) which performs a constant voltage control to stabilize circuit operation. The shunt regulator described in JP-A-2007-66035 performs a control so that the potential of a VSUP line (a circuit voltage of the current monitoring device) becomes equal to a reference potential VR. The reference potential VR is fixed by means of a resistor and a reference voltage source VREF such as a Zener diode. This type of shunt regulator is also used in general two-wire transmitters.

Incidentally, in recent years, two-wire transmitters have come to be required to be increased further in circuit operation speed, enhanced in insulation performance to increase the sensor S/N ratio, and added with such functions as self-diagnosis. To satisfy such requirements, it is necessary to secure more consumable power in the circuit.

However, in conventional two-wire transmitters, as described later, it is difficult to attain both of securing of more consumable power in the circuit and stabilization of circuit operation by the shunt regulator.

In a two-wire transmitter used as a field device, the current (supply current) that is supplied from the external circuit is varied as the output current signal varies (4 to 20 mA). On the other hand, the power voltage of the external circuit, which corresponds to the circuit voltage of the two-wire transmitter plus voltage drops across a feedback resistor and a detection resistor through which the supply current flows, is approximately constant.

However, as the output current of the two-wire transmitter increases and the supply current increases accordingly, the voltage drops across the feedback resistor and the detection resistor are increased and the securable circuit voltage is lowered. The circuit voltage of the two-wire transmitter is minimized when the output current is equal to the maximum value (20 mA). From another point of view, at least a circuit voltage corresponding to the maximum output current can always be secured irrespective of the output current.

In view of the above, in conventional two-wire transmitters, the shunt regulator fixes the circuit voltage in a low voltage range around the power source voltage minus its own maximum voltage drop. With this measure, although the circuit operation is stabilized, because of the low circuit voltage only a small consumable power is secured when the output current is small (e.g., 4 mA) and hence the supply current is small.

SUMMARY OF THE INVENTION

Exemplary embodiments of the present invention address the above disadvantages and other disadvantages not described above. However, the present invention is not required to overcome the disadvantages described above, and thus, an exemplary embodiment of the present invention may not overcome any disadvantages.

It is an illustrative aspect of the present invention to provide a two-wire transmitter which can secure a sufficient consumable power even when the output current is small and which is thus improved in performance. Also, it is another illustrative aspect of the present invention to provide a two-wire transmitter which can generate a desired circuit voltage even in the event of an abnormality.

According to one or more illustrative aspects of the present invention, there is provided a two-wire transmitter which is connected to an external circuit by two transmission lines and which outputs a certain current signal to the external circuit using the external circuit as a power source. The two-wire transmitter includes: a sensor configured to convert a physical quantity into a first electrical signal and output the first electrical signal; a signal processing circuit configured to perform certain processing on the first electrical signal and output a second electrical signal; a constant current circuit configured to determine the certain current signal to be output to the external circuit, based on the second electrical signal; a reference voltage output unit configured to output a reference voltage based on the second electrical signal; and a shunt regulator circuit configured to determine a circuit voltage of the two-wire transmitter based on the reference voltage.

With the above configuration, the circuit current can be controlled dynamically according to the output current. For example, when the current that is supplied from the external circuit is small (low output state), the circuit voltage can be controlled so as to be increased. This control makes it possible to relax a restriction relating to power that can be consumed in the circuit. Therefore, even in a low output state, a sufficient consumable power to, for example, increase the circuit operation speed and add new functions can be secured. Enhancement in the performance of the two-wire transmitter can thus be realized.

Other aspects and advantages of the present invention will be apparent from the following description, the drawings and the claims.

BRIEF DESCRIPTION OF THE DRAWINGS

FIG. 5 is a truth table of a changeover switch SW4 which is used in the two-wire transmitter of FIG. 4.

DETAILED DESCRIPTION

Preferred embodiments of the present invention will be hereinafter described in detail with reference to the accompanying drawings. Dimensions, materials, and other specific numerical values etc. disclosed in the embodiments are just examples for facilitating the understanding of the invention and should not be construed as restricting the invention unless otherwise specified. In this specification including the drawings, elements having substantially the same function or constitution are given the same reference symbol and may not be described redundantly or may be omitted in a drawing.

Figure 1:
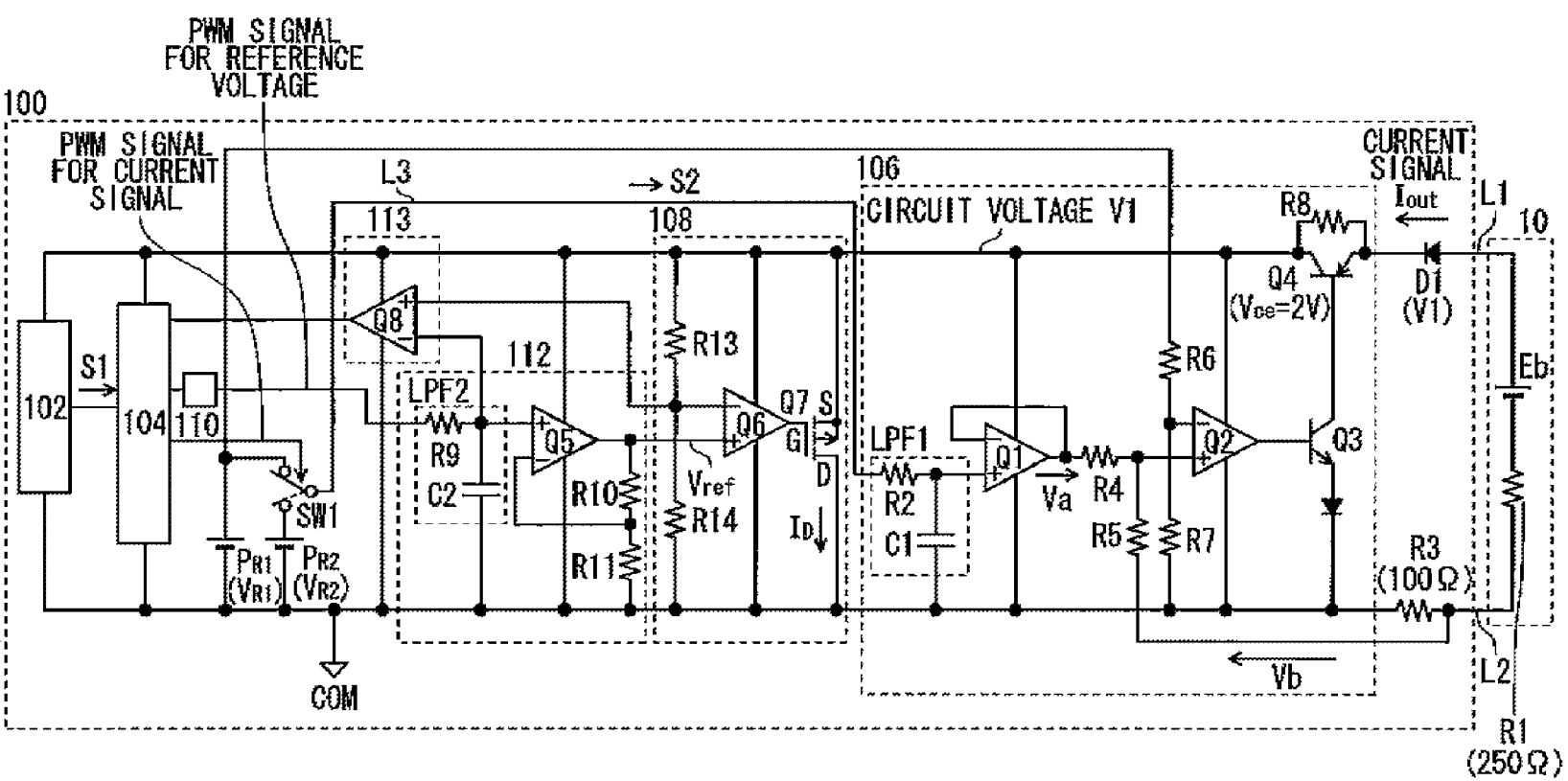
FIG. 1 is a circuit diagram of a two-wire transmitter according to an embodiment of the present invention.

FIG. 1 is a circuit diagram of a two-wire transmitter according to an embodiment of the invention. As shown in FIG. 1, a two-wire transmitter 100 is connected to an external circuit 10 by two transmission lines L1 and L2 and uses the external circuit 10 as a power source. The two-wire transmitter 100, which is a field device such as a differential pressure/pressure transmitter or a temperature transmitter, outputs a prescribed current signal indicating a physical quantity to the external circuit 10.

Composed of a voltage source $E_b$ and a detection resistor R1 which are connected to the transmission lines L1 and L2 in series, the external circuit 10 supplies a power voltage $E_b$ to the two-wire transmitter 100 and acquires a physical quantity measured by the two-wire transmitter 100 by reading the voltage across the detection resistor R1.

(Measurement of Physical Quantity)

The configuration of the two-wire transmitter 100 will be described by describing how a physical quantity measurement operation proceeds. The two-wire transmitter 100 is equipped a sensor 102, which converts a physical quantity such as a pressure, a temperature, or the like into an electrical signal S1 and outputs the electrical signal S1 to a signal processing circuit 104. The signal processing circuit 104 performs prescribed processing such as linearity correction (distortion correction) and noise elimination on the received electrical signal S1, converts a resulting signal into a PWM signal for a current signal, and outputs the PWM signal to a switch SW1 as a switching control signal.

The positive pole of a reference voltage source $P_{R1}$ having an output voltage $V_{R1}$ and the positive pole of a reference voltage source $P_{R2}$ having an output voltage $V_{R2}$ are connected to the two respective fixed contacts of the switch SW1, and a movable contact of the switch SW1 is connected to a line L3. The movable contact of the switch SW1 is selectively connected to the positive poles of the reference voltage sources $P_{R1}$ and $P_{R2}$ according to the voltage level of the PWM signal for a current signal. As the movable contact of the switch SW1 is switched, an electrical signal S2 whose voltage level is switched between the voltages $V_{R1}$ and $V_{R2}$ flows through the line L3 whose one end is connected to the movable contact of the switch SW1.

A constant current circuit 106 is connected to the other end of the line 13. The constant current circuit 106 determines a value (4 to 20 mA) of a current signal $I_{out}$ which is output to the external circuit 10, according to the electrical signal S2 flowing through the line L3, in other words, the electrical signal S1 which is output from the sensor 102. The electrical signal S2 flowing through the line L3 is smoothed into an analog signal by a filter LPF1 which is composed of a resistor R2 and a capacitor C1. The analog signal is buffered by a buffer amplifier Q1 and a resulting output voltage $V_A$ is output from the output terminal of the buffer amplifier Q1.

A difference voltage between the output voltage $V_A$ and a feedback voltage $V_b$ across a feedback resistor R3 is divided by resistors R4 and R5 and the feedback resistor R3 and a resulting divisional voltage is input to the non-inverting input terminal of an error amplifier Q2. The voltage $V_{R1}$ of the reference voltage source $P_{R1}$ is divided by resistors R6 and R7 and a resulting divisional voltage is input to the inverting input terminal of an error amplifier Q2.

The error amplifier Q2 detects an error between the voltages that are input to its non-inverting input terminal and the inverting input terminal, and cooperates with transistors Q3 and Q4 to control currents flowing through the circuit so that the two input voltage coincide with each other. The output voltage of the error amplifier Q2 is input to the base of the transistor Q3 and serves to control its collector current. The collector of the transistor Q3 is connected to the base of the transistor Q4, and the transistor Q3 serves to control its base current.

An activation resistor R8 is connected between the emitter and the collector of the transistor Q4, and the transmission line L1 is connected to the emitter of the transistor Q4. As the transistor Q3 controls the base current of the transistor Q4, a current is pulled out of (supplied from) the external circuit 10 to the emitter of the transistor Q4 through the transmission line L1. The current that is drawn out of the external circuit 10 by the transistor Q4 is the current that corresponds to the output electrical signal S1 of the sensor 102, that is, the current signal $I_{out}$ (4 to 20 mA). The current signal $I_{out}$ is output to the detection resistor R1 of the external circuit 10 via the transmission line L2, whereby the external circuit 10 detects a result of the physical quantity measurement using the sensor 102.

(Constant Voltage Control)

Another part of the configuration of the two-wire transmitter 100 will be described by describing how a constant voltage control operation proceeds which is the most important feature of the two-wire transmitter 100. To stabilize its circuit operation, the two-wire transmitter 100 is equipped with a shunt regulator circuit 108 which performs a constant voltage operation. In particular, the two-wire transmitter 100 dynamically controls a circuit voltage V1 according to the output current signal $I_{out}$. This makes it possible to secure a sufficient consumable power in the circuit even when the current (4 to 20 mA) supplied from the external circuit 10 is small.

A reference voltage output unit 110 is connected to the signal processing circuit 104. The signal processing circuit 104 outputs, to the reference voltage output unit 110, a prescribed electrical signal (e.g., a merely amplified version of the electrical signal S1) that corresponds to the output electrical signal S1 of the sensor 102. The reference voltage output unit 110 outputs a reference voltage to the shunt regulator circuit 108 according to the electrical signal that is input from the signal processing circuit 104. The reference voltage is a voltage to be used as a reference of a constant voltage control performed by the shunt regulator circuit 108. In the embodiment, the reference voltage is a duty-ratio-varied PWM signal for a reference voltage.

The reference voltage output unit 110 is connected to a reference voltage processing circuit 112. Disposed between the reference voltage output unit 110 and the shunt regulator circuit 108, the reference voltage processing circuit 112 performs prescribed processing on the PWM signal for a reference voltage. Having a filter LPF2 which is composed of a resistor R9 and a capacitor C2, the reference voltage processing circuit 112 smoothes the PWM signal for a reference voltage into an analog signal. The analog signal is amplified by an error amplifier Q5. The error amplifier Q5 performs negative feedback amplification using resistors R10 and R11, and a resulting output voltage $V_{ref}$ is output to the shunt regulator circuit 108.

The shunt regulator circuit 108 determines the circuit voltage V1 of the two-wire transmitter 100 according to the output voltage $V_{ref}$ of the error amplifier Q5. The shunt regulator circuit 108 is composed of an error amplifier Q6, a p-channel MOSFET (transistor Q7), resistors R13 and R14, etc.

The reference voltage $V_{ref}$ is supplied from the reference voltage processing circuit 112 to the non-inverting input terminal of the error amplifier Q6. A voltage obtained by dividing the circuit voltage V1 by the resistors R13 and R14 is input to the inverting input terminal of the error amplifier Q6. The error amplifier Q6 detects an error between the voltages that are input to its non-inverting input terminal and inverting input terminal, and cooperates with the transistor Q7 to control the circuit voltage V1 so that the two voltages coincide with each other.

Figure 2:
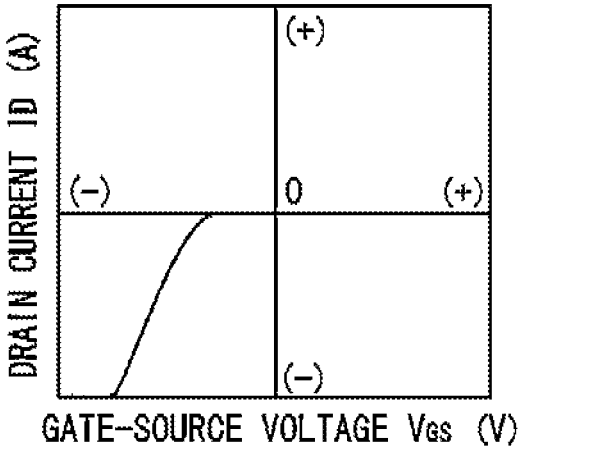
FIG. 2 is a graph showing the characteristic of a p-channel MOSFET.

The operation of the transistor Q7 (p-channel MOSFET) will be described below with reference to FIG. 2, FIG. 2 is a graph showing the characteristic of a p-channel MOSFET. In FIG. 2, the horizontal axis represents the gate-source voltage $V_{GS}$ (V) and the vertical axis represents the current $I_D$ (A) flowing from the source to the drain.

Majority Carriers of the p-channel MOSFET are holes, and a current $I_D$ flows in the direction from the drain to the source when the gate voltage is lower than the source voltage (i.e., the gate-source voltage $V_{GS}$ is negative). The absolute value of the current $I_D$ increases as the absolute value of the negative gate-source voltage $V_{GS}$ increases, and the current $I_D$ becomes zero when the gate-source voltage $V_{GS}$ has a prescribed negative value.

The reference voltage output unit 110 of the two-wire transmitter 100 shown in FIG. 1 outputs a PWM signal for a reference voltage having a larger duty ratio when the electrical signal that is output form the signal processing circuit 104 is smaller, that is, the electrical signal S1 that is output from the sensor 102 is smaller. This means that as the current (current signal $I_{out}$ supplied from the external circuit 10 decreases, the reference voltage $V_{ref}$ for the error amplifier Q6 is increased and the gate-source voltage $V_{GS}$ of the transistor Q7 is varied toward the positive side.

With the above operation, the absolute value of the current $I_D$ flowing through the transistor Q7 decreases in proportion to the current signal $I_{out}$ and the reduction of the circuit voltage V1 caused by the transistor Q7 is suppressed, as a result of which the circuit voltage V1 is increased as the current signal $I_{out}$ decreases. The voltage at the inverting input terminal of the error amplifier Q6 is increased, and the circuit voltage V1 is stabilized when the voltage at the inverting input terminal of the error amplifier Q6 finally becomes equal to the reference voltage $V_{ref}$ that is input to the non-inverting input terminal of the error amplifier Q6. The above negative feedback operation of the shunt regulator circuit 108 is represented by the following Equation (1):

$$\text{Circuit voltage } V1=\{1+(R13/R14)\}\times V_{ref} \quad (1)$$

The two-wire transmitter 100 is equipped with a comparator circuit 113 for detecting an abnormal state of the circuit voltage V1. The comparator circuit 113 detects reduction of the circuit voltage V1 as an abnormal state using a comparator Q8 provided therein. A voltage corresponding to the PWM signal for a reference voltage is input to the inverting input terminal of the comparator Q8. A voltage obtained by dividing the circuit voltage V1 by the resistors R13 and R14 is input to the non-inverting input terminal of the comparator Q8. The comparator Q8 compares these voltages. If the voltage at the non-inverting input terminal lowers, the comparator Q8 notifies the signal processing circuit 104 of occurrence of an abnormality by inverting its output voltage. In response, the signal processing circuit 104 performs, for example, processing of storing a current value of the electrical signal S1.

As described above, in the two-wire transmitter 100, the circuit voltage V1 can be controlled dynamically according to the output current. In particular, the power that can be consumed in the circuit can be increased (restrictions can be relaxed) by increasing the circuit voltage V1 as the output current decreases, that is, the current that is supplied from the output circuit 10 decreases. Therefore, a sufficient consumable power to, for example, increase the circuit operation speed and add new functions can be secured even in a low output state. Further enhancement in performance can thus be realized.

Each of the reference voltage output unit 110 and the signal processing circuit 104 can perform control with a low power loss because they perform PWM control.

(Comparison with Conventional Two-Wire Transmitter)

Figure 3:
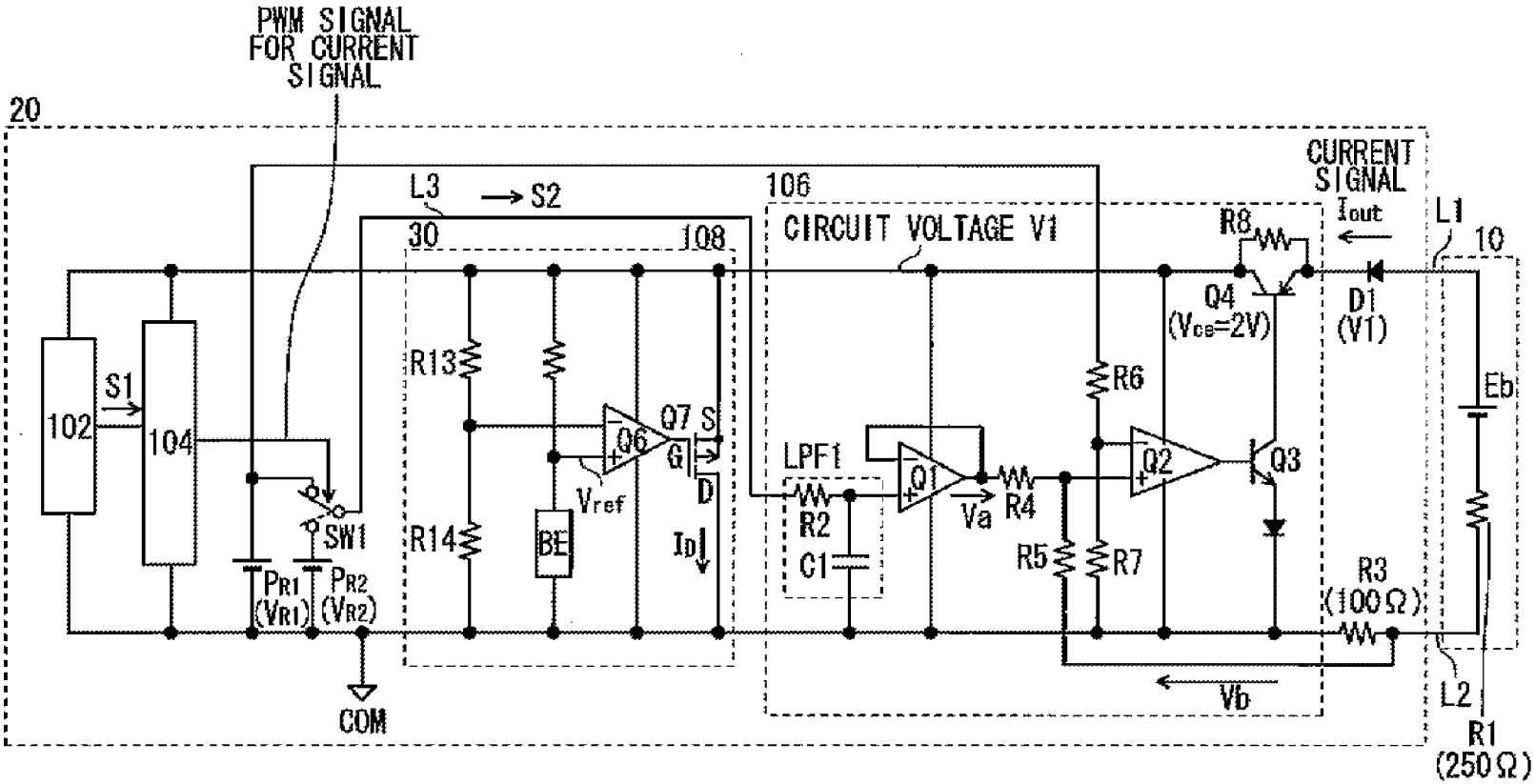
FIG. 3 is a circuit diagram of a conventional two-wire transmitter.

FIG. 3 is a circuit diagram of a conventional two-wire transmitter. In the following, consumable power that can be secured in the two-wire transmitter 100 shown in FIG. 1 will be compared with consumable power secured in the conventional two-wire transmitter 20 shown in FIG. 3.

First, a description will be made of an example calculation of consumable power of the conventional two-wire transmitter 20 in the case where the current signal $I_{out}$ is equal to 20 mA (maximum output state). Assume that the power voltage $E_t$, of the external circuit 10 is 16 V, the detection resistance R1 is 250Ω, the feedback resistance R3 is 100Ω, the collector-emitter voltage $V_{CC}$ of the transistor Q4 is 2 V, and the forward voltage of the diode D1 is 1 V. The circuit voltage V1 is given by the following Equation (2):

$$\text{(Circuit voltage } V1)=16(\text{V})-20\ (\text{mA})\times(100(\Omega)+250(\Omega))-2(\text{V})-1(\text{V})=6(\text{V}) \quad (2)$$

Consumable power that can be secured with the circuit voltage V1 (=6 V) of Equation (2) in the maximum output state (20 mA) is given by the following Equation (3):

$$6(\text{V})\times 20\ (\text{mA})=120\ (\text{mW}) \quad (3)$$

When the current signal $I_{out}$ is equal to 20 mA (the state of Equations (2) and (3)), the voltage drops across the detection resistor R1 and the feedback resistor R3 are at the maximum. That is, at least the circuit voltage V1=6 V can be secured even with such maximum voltage drops.

A further description will be made with reference to FIG. 3. The two-wire transmitter 20 shown in FIG. 3 is different from the two-wire transmitter 100 shown in FIG. 1 in that the reference voltage output unit 110 and the reference voltage processing circuit 112 are not provided and the reference voltage $V_{ref}$ for the error amplifier Q6 is fixed by a reference potential element BE. The circuit voltage V1 is fixed in the conventional two-wire transmitter 20. In particular, in the conventional two-wire transmitter 20, the circuit voltage V1 is fixed at the voltage for the maximum voltage drop state. Therefore, in the conventional two-wire transmitter 20, if the circuit voltage V1 is fixed at, for example, 6 V (Equation (2)), consumable power that is obtained when the current signal $I_{out}$ is equal to 4 mA (minimum output state) is given by the following Equation (4):

$$6(\text{V})\times 4\ (\text{mA})=24\ (\text{mW}) \quad (4)$$

On the other hand, in the two-wire transmitter 100 shown in FIG. 1, the circuit voltage V1 can be increased as the output current decreases. Whereas the consumable power that can be secured in the maximum output state is the same as in the conventional two-wire transmitter 20, a higher consumable power can be secured (higher than in the conventional two-wire transmitter 20) as the output current decreases. The following Equation (5) is an example calculation of a circuit voltage V1 that can be secured in the minimum output state (4 mA). Equation (5) is different from Equation (2) in that 20 mA (current signal $I_{out}$) in Equation (2) is replaced by 4 mA.

$$(\text{Circuit voltage } V1)=16(\text{V})-4\ (\text{mA})\times(100(\Omega)+250(\Omega))-2(\text{V})-1(\text{V})=11.6(\text{V}) \quad (5)$$

Using the circuit voltage V1 (=11.6 V) of Equation (5), consumable power that can be secured in the minimum output state (4 mA) is given by the following Equation (6):

$$11.6(\text{V})\times 4\ (\text{mA})=46.4\ (\text{mW}) \quad (6)$$

By comparing Equation (6) with Equation (4), it is understood that consumable power that is secured in the minimum output state in the two-wire transmitter 100 shown in FIG. 1 is about two times as high as in the two-wire transmitter 20 shown in FIG. 3.

(Example Settings)

A description will be made of example settings, for realizing the consumable power of Equation (6) (46.4 mW corresponding to the output current 4 mA), of the duty ratio of the PWM signal for a reference voltage in the reference voltage output unit 110 and the gain of the error amplifier Q5 of the reference voltage processing circuit 112 in the two-wire transmitter 100. First, the reference voltage $V_{ref}$ for the error amplifier Q6 of the shunt regulator circuit 108 will be calculated. The reference voltage $V_{ref}$ is calculated by the following Equations (7) and (8). Equation (7) is a symbolized version of Equations (2) and (5) for calculating a circuit voltage V1.

$$V1=E_b_\text{min}-I_{out}(R3_\text{max}+R1_\text{max})-A \quad (7)$$

In Equation (7), V1 is the circuit voltage, $E_b$_min is the minimum power voltage, $I_{out}$ is the current signal, R3_max is the maximum resistance of the feedback resistor R3, R1_max is the maximum resistance of the detection resistor R1, and A is the maximum voltage drop of the diode and transistor used.

$$V1=\{I\div(R13/R14)\}\times V_{ref} \quad (8)$$

In Equation (8), V1 is the circuit voltage, R13 and R14 are the resistance values of the resistors R13 and R14, and $V_{ref}$ is the reference voltage for the error amplifier Q6. {1÷(R13/R14)} is the gain of the error amplifier Q6.

A circuit voltage V1 will be calculated by substituting actual values of the individual elements into Equation (7). When the current signal $I_{out}$ is equal to 4 mA, a circuit voltage V1 is calculated as in the following Equation (9):

$$V1=16.6(\text{V})-4\ (\text{mA})\times(101(\Omega)+250(\Omega))-1.1(\text{V})-2(\text{V})=12.10(\text{V}) \quad (9)$$

in Equation (9), $E_b$_min is set at 16.6 V by referring to conventional two-wire transmitters. R1_max which is the maximum resistance of the detection resistor R1 that can be connected with the power voltage 16.6 V is set at 250Ω. R3_max is set at the maximum value 101Ω of a specification range 100 Ω±1% of the conventional feedback resistor R3. By referring to elements used in conventional two-wire transmitters, the parameter A is set at 1.1 V+2 V where 1.1 V is the forward voltage of the diode D1F60 and 2 V is the collector-emitter voltage (for avoiding the saturation region) of the transistor 2SA1385.

The reference voltage $V_{ref}$ will be calculated according to Equation (8). If it is assumed that R13 and R14 have the same value and have an error range of ±1%, the gain (1+(R13/R14) in Equation (8)) of the error amplifier Q6 for the reference voltage $V_{ref}$ is in a range of 1.98 to 2.02. Assuming that the gain in Equation (8) is equal to 2.02 and the circuit voltage V1 is equal to 12.10 V that was calculated by Equation (9), the following Equation (10) which includes the reference voltage $V_{ref}$ is obtained.

$$12.10(\text{V})=2.02\times V_{ref} \quad (10)$$

From Equation (10), the reference voltage $V_{ref}$ is calculated as 5.99 V,

Next, the duty ratio of the PWM signal for a reference voltage will be determined. When the PWM frequency, the PWM voltage, and the duty ratio of the PWM signal for a reference voltage were set at 33 kHz, 3.3 V, and 90%, respectively, the DC voltage produced by the filter LPF2 (see FIG. 1) through smoothing was calculated as 2.96 V by a simulation. It is understood that to produce the reference voltage $V_{ref}$ 5.99 V that is obtained from Equation (10) using the DC voltage 2.96 V, the gain of the error amplifier Q5 should be equal to about 2.

With a PWM signal for a reference voltage which has the above duty ratio and the error amplifier Q5 having the above gain, the circuit voltage V1 can be controlled approximately in the same manner as in the above example calculation of Equation (6). Since the comparator circuit 114 detects a voltage reduction on the basis of a PWM signal for a reference voltage which has the above duty ratio, it can detect an abnormal state properly even if the circuit voltage V1 varies.

Incidentally, in the configuration of FIG. 1, if the signal processing circuit 104 goes abnormal (e.g., out of control), it cannot output a prescribed PWM signal for a reference voltage to render the PWM signal indefinite. This results in a problem that the current flowing through the transmission lines L1 and L2 cannot have a normal value although it should burn out (i.e., should become smaller than 3.6 mA or larger than 21.6 mA).

Figure 4:
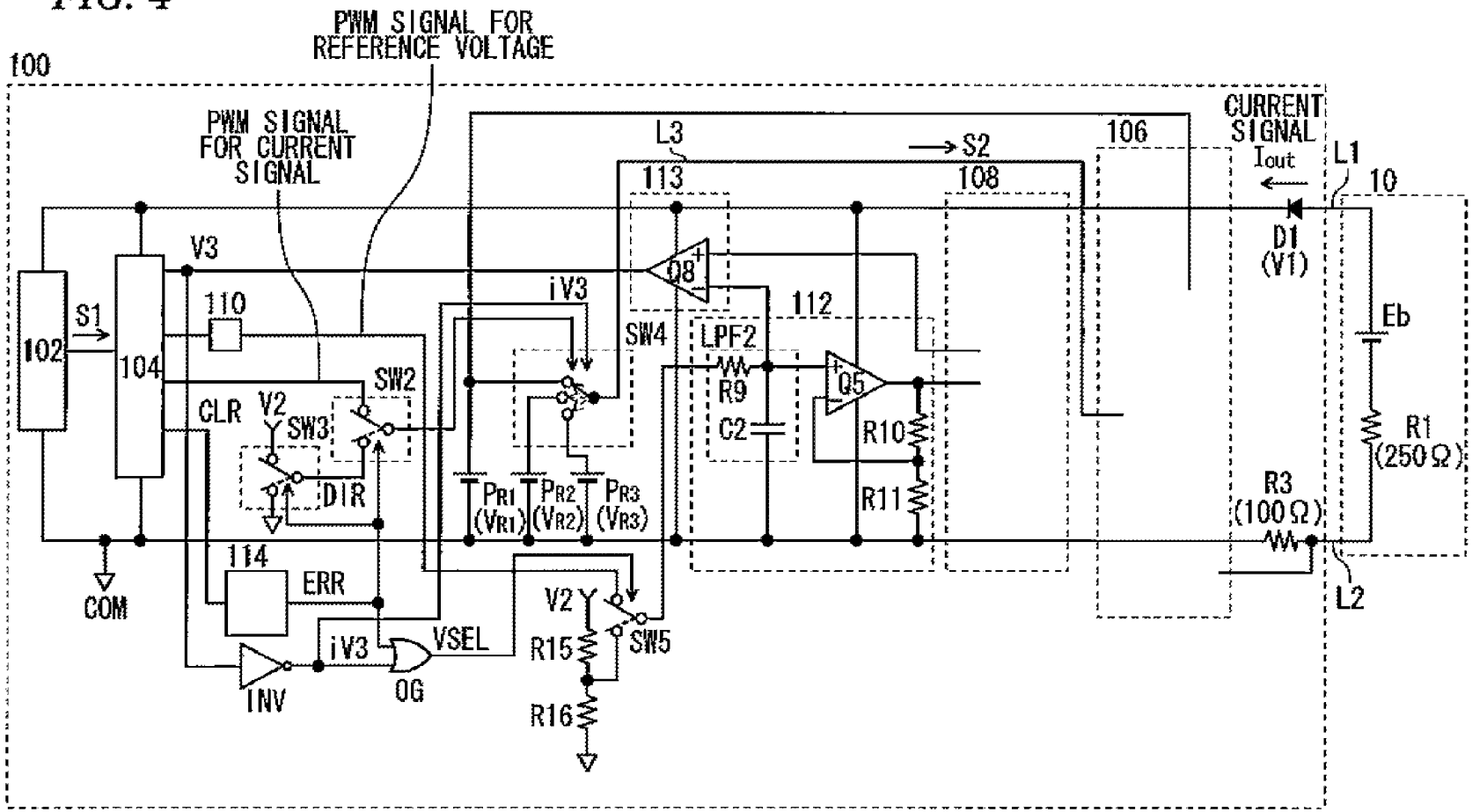
FIG. 4 is a circuit diagram of a two-wire transmitter according to another embodiment of the invention.

For example, this problem can be solved by a circuit configuration shown in FIG. 4. FIG. 4 is a circuit diagram of a two-wire transmitter 100A according to another embodiment of the invention. In FIG. 4, part (the circuits 106 and 108) of the circuits that also exist in FIG. 1 are omitted.

Referring to FIG. 4, a changeover switch SW4 selectively outputs one of three voltages $V_{R1}$, $V_{R2}$, and $V_{R3}$ to the constant current circuit 106 according to an operation state of the signal processing circuit 104. More specifically, the positive pole of a reference voltage source $P_{R1}$ having an output voltage $V_{R1}$ is connected to a first fixed contact of the changeover switch SW4, the positive pole of a reference voltage source $P_{R2}$ having an output voltage $V_{R2}$ is connected to a second fixed contact, the positive pole of a reference voltage source $P_{R3}$ having an output voltage $V_{R3}$ is connected to a third fixed contact, and the movable contact is connected to a line L3.

A counter 114, which is a free-running counter for detecting an abnormality in the signal processing circuit 104, outputs an error signal ERR having a prescribed level corresponding to a state of the signal processing circuit 104 and is cleared by an edge of a clear signal CLR that is input from the signal processing circuit 104. If the signal processing circuit 104 is operating normally, the error signal ERR is cleared to have an L level. If the signal processing circuit 104 goes abnormal because its CPU becomes out of control, the error signal ERR is not cleared but overflows to have an H level.

The error signal ERR is input to changeover switches SW2 and SW3 as a switching control signal and input to one input terminal of an OR gate OG. An inverted version iV3 of the output signal V3 of the comparator Q8 is input to the other input terminal of the OR gate OG via an inverter INV. The output signal iV3 (symbol "i" means an inverted signal) of the inverter INV is also input to the changeover switch SW4. An output signal of the OR gate OG is input to a changeover switch SW5 as a voltage switching control signal VSEL.

The changeover switch SW2 is to selectively output a signal indicating a normal/abnormal state of the signal processing circuit 104. The PWM signal for a current signal which is output from the signal processing circuit 104 is input to one fixed contact of the changeover switch SW2, an output signal DIR of the changeover switch SW3 is input to the other fixed contact, and an output signal that is output from the movable contact is input to the changeover switch SW4 as a switching control signal.

The movable contact of the changeover switch SW2 selects the fixed contact to which the PWM signal for a current signal if the error signal ERR is at the L level (i.e., the signal processing circuit 104 is in a normal state), and selects the fixed contact to which the output signal DIR of the changeover switch SW3 is input if the error signal ERR is at the H level (i.e., the signal processing circuit 104 is in an abnormal state).

The changeover switch SW3 is to selectively output a current indicating that an abnormal state of the signal processing circuit 104 is excess to the upper limit side or a current indicating that an abnormal state of the signal processing circuit 104 is excess to the lower limit side. A circuit voltage V2 is input to one fixed contact of the changeover switch SW3, the other fixed contact is connected to a common potential point, and an output signal that is output from the movable contact is input to the above-mentioned fixed contact of the changeover switch SW2 as the abnormality direction indication signal DIR.

When the signal processing circuit 104 goes abnormal, the movable contact of the changeover switch SW3 selects one of the fixed contacts so that a current having a prescribed value indicating whether the abnormal state is excess to the upper limit side or the lower limit side flows through the line L3. If the abnormality direction indication signal DIR indicates excess to the upper limit side (e.g., larger than 21.6 mA), the movable contact of the changeover switch SW3 selects the fixed contact to which the circuit voltage V2 is input. If the abnormality direction indication signal DIR indicates excess to the lower limit side (e.g., smaller than 3.6 mA), the movable contact of the changeover switch SW3 selects the fixed contact to which the common potential point is connected.

The changeover switch SW5 is to select a voltage to be input to the reference voltage processing circuit 112. The PWM signal for a reference voltage is input to one fixed contact of the changeover switch SW5, the connecting point of series-connected resistors R15 and R16 is connected to the other fixed contact, and an output signal that is output from the movable contact is input to one end of the resistor R9 of the filter LPF2, The circuit voltage V2 is input to the end, opposite to the above connecting point, of the resistor R15, and the end, opposite to the above connecting point, of the resistor R16 is connected to the common potential point.

The movable contact of the changeover switch SW5 selects the fixed contact to which an arbitrary fixed voltage is input that is obtained by dividing the circuit voltage V2 by the resistors R15 and R16 if the output signal V3 of the comparator Q8 is at the L level (before activation or when the signal processing circuit 104 is abnormal). The movable contact of the changeover switch SW5 selects the fixed contact to which the PWM signal for a reference signal is input if the output signal V3 of the comparator Q8 is at the H level (after activation or when the signal processing circuit 104 is normal).

FIG. 5 is a truth table of the changeover switch SW4 which is based on the switching operations of the changeover switches SW2 and SW3.

Before activation (the signal processing circuit 104 is not in operation), since neither a PWM signal for a reference signal nor a PWM signal for a current signal cannot be output, the changeover switch SW4 supplies the constant current circuit 106 with the voltage $V_{R3}$ which enables a current flow through arbitrary transmission lines.

Furthermore, since the changeover switch SW5 supplies the fixed voltage to the resistor R9 of the reference voltage processing circuit 112, a desired circuit voltage V2 can be obtained irrespective of the operation state of the signal processing circuit 104.

When the signal processing circuit 104 is in an abnormal state and neither a PWM signal for a reference signal nor a PWM signal for a current signal cannot be output, the changeover switch SW2 supplies the changeover switch SW4 with an abnormality direction indication signal DIR indicating a current to flow through the transmission lines L1 and L2 at the time of an abnormality, whereby the changeover switch SW4 can supply the constant current circuit 106 with the voltage $V_{R1}$ or $V_{R2}$ which allows a desired current to flow through the transmission lines L1 and L2.

Also in this case, since the changeover switch SW5 supplies the fixed voltage to the resistor R9 of the reference voltage processing circuit 112 by hardware, a desired circuit voltage V2 can be obtained irrespective of the operation state of the signal processing circuit 104.

According to the embodiment of FIG. 4, even when the signal processing circuit 104 goes abnormal, the current flowing through the transmission lines L1 and L2 can be kept in a normal range while the power that can be consumed in the two-wire transmitter 100A is made as high as possible.

When the signal processing circuit 104 goes abnormal, the output current can reliably burn out in a prescribed direction that depends on an abnormal state.

While the present invention has been shown and described with reference to certain exemplary embodiments thereof, other implementations are within the scope of the claims. It will be understood by those skilled in the art that various changes in form and details may be made therein without departing from the spirit and scope of the invention as defined by the appended claims.

What is claimed is:

1. A two-wire transmitter which is connected to an external circuit by two transmission lines and which outputs a certain current signal to the external circuit using the external circuit as a power source, the two-wire transmitter comprising:

a sensor configured to convert a physical quantity into a first electrical signal and output the first electrical signal;

a signal processing circuit configured to perform certain processing on the first electrical signal and output a second electrical signal and a third electrical signal;

a constant current circuit configured to determine the certain current signal to be output to the external circuit, based on the second electrical signal;

a reference voltage output unit configured to output a reference voltage based on the third electrical signal; and a shunt regulator circuit configured to determine a circuit voltage of the two-wire transmitter based on the reference voltage.

2. The two-wire transmitter according to claim 1, wherein the reference voltage output from the reference voltage output unit is increased as the second electrical signal is decreased.

3. The two-wire transmitter according to claim 1, wherein the reference voltage is a Pulse Width Modulation (PWM) signal whose duty ratio is varied based on the second electrical signal, and wherein the two-wire transmitter further comprises:

a filter provided between the reference voltage output unit and the shunt regulator circuit so as to convert the PWM signal into an analog signal by smoothing the PWM signal.

4. The two-wire transmitter according to claim 1, further comprising: an operation state detector configured to detect an operation state of the signal processing circuit and output a detection signal; and a current setting unit configured to set a current flowing through the transmission lines to a certain current value, based on the detection signal.

5. The two-wire transmitter according to claim 4, wherein when the operation state detector detects an operation abnormality in the signal processing circuit, the current setting unit sets the current flowing through the transmission lines to a certain bum-out current corresponding to the detected operation abnormality.

6. The two-wire transmitter according to claim 1, wherein the physical quantity includes at least one of a pressure and a temperature sensed by the sensor.

7. The two-wire transmitter according to claim 1, wherein the shunt regulator circuit includes an amplifier that receives the reference voltage as an input.

8. The two-wire transmitter according to claim 7, wherein the shunt regulator circuit further includes a transistor that receives an output from the amplifier.

9. The two-wire transmitter according to claim 7, wherein the amplifier includes a first terminal that receives the reference voltage and a second terminal that receives a voltage derived from the circuit voltage.

10. The two-wire transmitter according to claim 1, wherein in response to the circuit voltage increasing and a current value of the certain current signal decreasing, an amount of power consumed by the two-wire transmitter increases.

11. The two-wire transmitter according to claim 1, wherein the shunt regulator circuit is configured to determine the circuit voltage by performing a constant voltage operation to dynamically control a value of the circuit voltage according to the certain current signal.

12. A two-wire transmitter comprising:

a sensor configured to receive a signal, sense a value of the signal, and output a first signal;

a signal processing circuit configured to perform certain processing on the first signal and output a second signal and a third signal;

a constant current circuit configured to determine a current value to be output from the two-wire transmitter based the second signal;

a reference voltage output unit configured to output a reference voltage based on the third signal; and a shunt regulator circuit configured to dynamically control a value of a circuit voltage using the reference voltage and the current value.

13. The two-wire transmitter according to claim 12, wherein the two-wire transmitter is configured to use an external circuit as a power source.

14. The two-wire transmitter according to claim 12, wherein in response to the circuit voltage increasing and the current value output from the two-wire transmitter decreasing, an amount of power consumed by the two-wire transmitter increases.

* * * * *